United States Patent [19]

Derome

[11] Patent Number: 4,674,255

[45] Date of Patent: Jun. 23, 1987

[54] SEALING PLUG FOR A CONE-TYPE ROD OPENING IN CONCRETE WALLS AND THE LIKE

[75] Inventor: Robert E. Derome, Dorchester, Mass.

[73] Assignee: Snap Seal, Boston, Mass.

[21] Appl. No.: 910,862

[22] Filed: Sep. 24, 1986

Related U.S. Application Data

[63] Continuation of Ser. No. 735,692, May 20, 1985, abandoned.

[51] Int. Cl.[4] ..... E04G 23/02

[52] U.S. Cl. ..... 52/514; 249/42; 249/210; 249/217

[58] Field of Search ..... 249/210–217; 52/514

[56] References Cited

U.S. PATENT DOCUMENTS

| | | | |
|---|---|---|---|
| 264,776 | 9/1882 | Sharp | 52/514 |
| 1,781,601 | 11/1930 | Rohaut et al. | 249/111 |
| 2,196,785 | 4/1940 | Takiguchi | 220/DIG. 19 |
| 2,968,047 | 1/1961 | Stilborn | 4/295 |
| 3,889,436 | 6/1975 | Elliott | 52/514 |
| 4,059,933 | 11/1977 | Funk et al. | 52/309.2 |

FOREIGN PATENT DOCUMENTS

| | | | |
|---|---|---|---|
| 133456 | 2/1948 | Australia | 411/373 |
| 1026533 | 2/1978 | Canada | 249/217 |
| 482080 | 1/1970 | Switzerland | 52/230 |
| 951956 | 3/1964 | United Kingdom | 217/211 |

*Primary Examiner*—James L. Ridgill, Jr.

*Attorney, Agent, or Firm*—Rines and Rines, Shapiro and Shapiro

[57] ABSTRACT

A sealing plug for a cone-type tie rod opening in concrete walls and the like formed by solid high density polyvinyl chloride of generally conical shape having a cylindrical head of diameter somewhat smaller than the mouth of the opening to permit insertion therein of the plug and provided with a peripheral front planar flexible lip of diameter slightly greater than said diameter of the head, the head tapering into a rear frusto-conical plug section, the overall length of the plug being small compared to said head diameter, such that the forcing of said plug into said opening causes the side walls of said head and at least part of said rear plug section to pressure-seal with adjacent concrete wall portions of said opening and with said lip resiliently pressed forward to effect a front peripheral seal. The plug may also be adapted with roughened side walls to intermix with concrete particles during plug insertion to lock the plug in the opening against withdrawal.

2 Claims, 2 Drawing Figures

SEALING PLUG FOR A CONE-TYPE ROD OPENING IN CONCRETE WALLS AND THE LIKE

Figure 1:
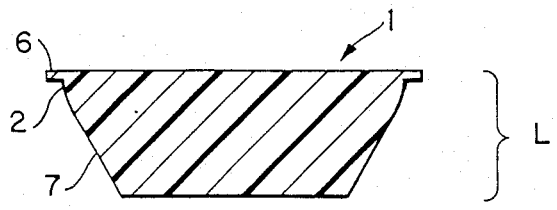

This is a continuation of application Ser. No. 735,692 filed May 20, 1985, now, abandoned.

The present invention relates to a sealing plug for a cone-type tie rod opening in concrete walls and the like, being more particularly concerned with a sealing plug formed of high density plastic that forms a pressure-seal with the adjacent concrete wall portions of the opening to effect a front peripheral seal.

In the formation of concrete walls, cast structures and the like, the fluid concrete is poured into a mold that has metal reinforcing tie rods extending between the walls of the mold. In common practice, these reinforcing rods are adapted with conical plastic members which penetrate the surface of the wall and form cone-type openings in the hardened concrete. After hardening, the conical plastic members are withdrawn from the concrete and the tie rod is cut off close to the bottom of the cone-type tie rod opening, leaving the majority of the rod in the concrete for reinforcement.

The cone-type tie rod openings create a weakness in the concrete wall, or other structure. Water or other corrosives can enter the openings and disintegrate the exposed tie rod. Additionally, the large surface irregularities of the concrete wall created by the openings provide a less resistant surface to wear, such as by the wind. Finally, the holes in the concrete wall provides a less aesthetically pleasing surface than would a smooth wall, or a wall without deep holes.

Present sealing plugs for cone-type tie rod openings require additional hardware to be mounted in the opening, as by attachment to the tie rod end that protrudes into the opening, or by using a tie rod that has special plug-attachment hardware. They are frequently injection-molded hollow plastic plugs which require epoxy or glue to try to keep them in place. Hollowed rubber plugs have also been tried, but reaction to sun drying and other weather, causes crumbling at the edge and frequent pop-out. Such plugs include the T-shaped crosssection TXSCRU set back plug produced by Richmond Screw and Anchor, Dayton, Ohio, and the similar B-40 plastic set-back plug, as well as the hollow center A-58 and B-3 screw-on coil tie, produced by Dayton Sure-Grip and Shore Company, Dayton, Ohio, none of which provide a fluid resistant seal around the periphery of the plug and therefore allow water or other corrosive access to the exposed end portion of the rod and the special plug-attachment hardware; and, as before stated, often they pop out, as well.

Additional prior plugs include a smooth frustoconical rubber or plastic plug, such as the A-54 concrete plug produced by Dayton Sure-Grip, the SSP plastic setback plug produced by Richmond Screw and Anchor and the concrete hole plug produced by Gates Forming Systems, Denver, Colorado. These smooth plugs are held in by cement or epoxy which is subject to critical deterioration and fracture failure during use, especially during periods of wide temperature variation.

The present invention provides a solid frusto-conical plug formed of a high density plastic, as distinguished from rubber or injection molded hollow plugs, that can be merely inserted as by tap-forcing into a cone-type tie rod opening and thereby secured in the opening by frictional contact with the adjacent concrete walls of the opening, removing the necessity for special plug-attachment hardware and for epoxy or adhesive materials. Additionally, the plug has a peripheral front planar flexible lip of diameter slightly greater than the diameter of the plug head such that frictional engagement of the plug within the opening deforms the lip and forms an effective fluid-tight seal. The plug may also be adapted with a roughened side wall portion, as by knurling, for example, to intermix with the concrete particles of the opening when the plug is forced into the opening. Such roughened portion aids the friction at contact between the plug and the walls of the opening to lock the plug in the opening against withdrawal.

It is therefore a primary object of the present invention to provide a new and improved sealing plug for a cone-type tie rod opening in concrete walls and the like, that shall not be subject to the above-described disadvantages and/or limitations or inadequacies of prior plugs, but that, rather, provides a novel sealing plug that forms a fluid-tight seal in a cone-type tie rod opening in concrete walls or the like.

A further object is to provide a novel solid sealing plug that frictionally engages the inner walls of the cone-type tie rod opening to secure the plug within the opening without the need for special plug-attachment hardware or for adhesives.

Other and further objects and advantages will be explained hereinafter and are more particularly delineated in the appended claims.

In summary, from one of its important applications, the invention embraces a sealing plug for a cone-type tie rod opening in concrete walls and the like formed of solid high density polyvinyl chloride of generally conical shape having a cylindrical head of diameter somewhat smaller than the mouth of the opening to permit insertion therein of the plug provided with a peripheral front planar flexible lip of diameter slightly greater than said diameter of the head, the head tapering into a rear frusto-conical plug section, the overall length of the plug being small compared to said head diameter, such that the forcing of said plug into said opening causes the side walls of said head and at least part of said rear plug section to pressure-seal with adjacent concrete wall portions of effect a front peripheral seal. Other inventive features and operational details are hereinafter set forth.

Figure 2:
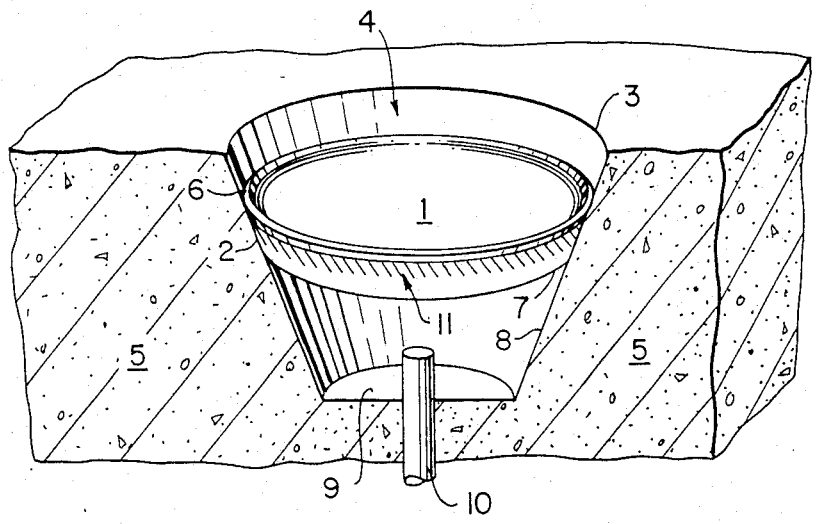

The invention will now be described with reference to the accompanying drawings:

FIG. 1 of which is a longitudinal section of a plug formed in accordance with a preferred form of the invention; and FIG. 2 is an elevated front perspective view of a plug of the present invention inserted into a cut-away portion of a concrete wall showing the peripheral front planar flexible lip deformed to form a fluid tight seal.

Referring to FIGS. 1 and 2, wherein like numbers designate like parts, a sealing plug 1, made of solid high density polyvinyl chloride or the like having a generally frusto-conical shape, is provided with a cylindrical head 2 of a diameter somewhat smaller than the mouth 3 of the opening 4 of the concrete wall 5, or the like, to permit insertion of the plug 1 therein. The plug 1 is also provided with a peripheral front planar flexible lip 6 of a diameter slightly greater than the head 2, where front refers to the top of the plug as shown in FIG. 1. The diameter of the lip 6 may have a diameter equal to or slightly greater than the diameter of the mouth 3 of the opening 4 of the concrete wall 5, but preferably has a diameter somewhat less than the diameter of the mouth 3.

The head 2 of the plug 1 tapers into a rear frusto-conical plug section 7 having a taper approximately equal to the taper of the interior walls 8 of the opening 4. The overall length L (or depth) of the plug is small compared to the diameter of the head 2 such that the forcing of the plug 1 into the opening 4 causes the side walls 8 to frictionally engage at least a part of the surface of the head 2, and rear conical section 7 of the plug 1 to pressure seal portions of the opening 4 between the mouth 3 and bottom 9 of the opening 4, for example to protect the exposed tie rod end 10 within the opening 4. In such a pressure seal, the lip 6 is resiliently pressed forward or deformed to effect a front peripheral seal, as shown in FIG. 2.

Preferably the overall length L of the plug 1 is no more than 0.25–0.50 inch, more or less, for a head 2 of diameter approximately 1.20 inches (say from 1–2 inches) and such would be used to seal a conical opening 4 with a mouth 3 diameter of approximately 1.25 inches and a depth of approximately 1.50 inches. The solid plug 1 can be of sufficient dimension so as to seal the opening 4 with the front or top of the plug 1 substantially flush with the top of the opening 4 to provide a smooth wall surface 5 or may be of dimensions that would secure the plug 1 recessed within the opening 4 below or rearward of the mouth 3 of the opening 4, as shown in FIG. 2.

The sealing plug 1 may also be adapted with a roughened portion of the side walls of the plug 1 on the head 2 and/or conical section 7, as by cutting or otherwise forming grooves or knurls 11 in the plug 1, to intermix, during the forcing of the plug 1 into the opening 4, with concrete particles in the opening walls 8 to increase the frictional contact between the plug 1 and the opening walls 8 to lock the plug 1 in the opening 4 against withdrawal. The insertion process, whereby the plug is tapforced into the opening, totally obviates the need for any epoxy or other adhesives and strongly resists withdrawal. In pull-out tests, the plug could not be withdrawn with as much as 350 pounds of pull. The use of this type of PVC plug has been shown to resist acids and any degradation under heat, and to completely seal the opening from water entry, and the plugs survived more than 15,000 pounds per square inch of compression.

Further modifications will also occur to those skilled in the art, and such are considered to fall within the spirit and scope of the invention as defined in the appended claims.

What is claimed is:

1. In combination, a concrete wall having a conical tie rod opening with a tapered inner periphery, and a solid, generally frustro-conical sealing plug body of high density polyvinyl chloride received in tight retention in said opening, said sealing plug body comprising a cylindrical head portion having a diameter somewhat smaller than a mouth of said opening and having a sidewall portion in frictional sealing engagement with the inner periphery of said opening, a frustro-conical rear portion tapered substantially complementary to the inner periphery of said opening and having a sidewall portion in frictional sealing engagement with the inner periphery of said opening, said head portion tapering into said rear portion, and a resiliently deformable planar peripheral lip encircling a front end of said plug body, said lip having an outer diameter slightly greater than the diameter of said head portion and being resiliently pressed forward from said front end and in sealing engagement with the inner periphery of said opening, said plug body having an overall length which is small relative to the diameter of said head portion.

2. The combination of claim 1, wherein at least one of said sidewall portion of said head portion and said sidewall portion of said rear portion has a roughened portion intermixed with concrete particles of the inner periphery of said opening and enhancing frictional engagement of said one sidewall portion with the inner periphery of said opening, thereby locking said plug body within said opening against withdrawal.

* * * * *